United States Patent [19]

Smrt

[11] 4,396,153

[45] Aug. 2, 1983

[54] SPRAY TIP FOR AEROSOL CAN

[76] Inventor: Thomas J. Smrt, 172 S. Northwest Hwy., Cary, Ill. 60013

[21] Appl. No.: 305,285

[22] Filed: Sep. 24, 1981

[51] Int. Cl.[3] ..... B05B 1/00

[52] U.S. Cl. ..... 239/337; 239/597; 239/600

[58] Field of Search ..... 239/150, 151, 337, 579, 239/597, 599, 600, 601, 602; 222/402.13, 402.22, 402.15, 611, 505, 135, 602

[56] References Cited

U.S. PATENT DOCUMENTS 3,817,429 6/1974 Smrt ..... 239/562

*Primary Examiner*—John J. Love
*Assistant Examiner*—Jon M. Rastello

[57] ABSTRACT

A spray tip for an aerosol can has two pairs of flexible and resilient wings which extend outwardly from opposite sides of a spraying orifice in the tip. The wings cooperate with inclined surfaces in the bottom wall of a can holder in a spraying apparatus to orient the spray tip so that the spraying orifice is properly aligned with respect to the direction in which the spraying apparatus is moved. The wings can also cooperate with a sliding actuating bar which will engage the wings and align the spray tip.

10 Claims, 17 Drawing Figures

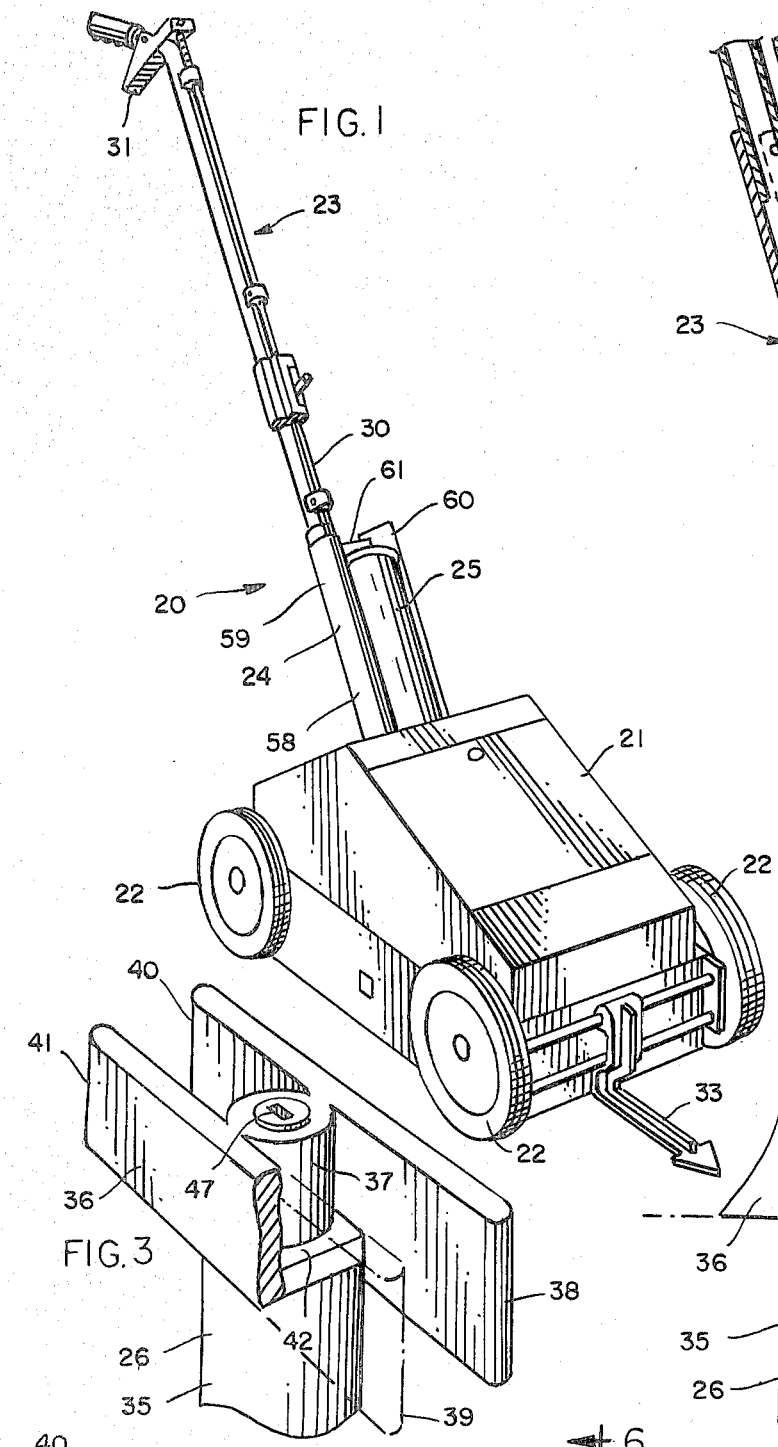
FIG. 1
31
23
30
61
60
25
20
59
24
58
21
22
22
22
33
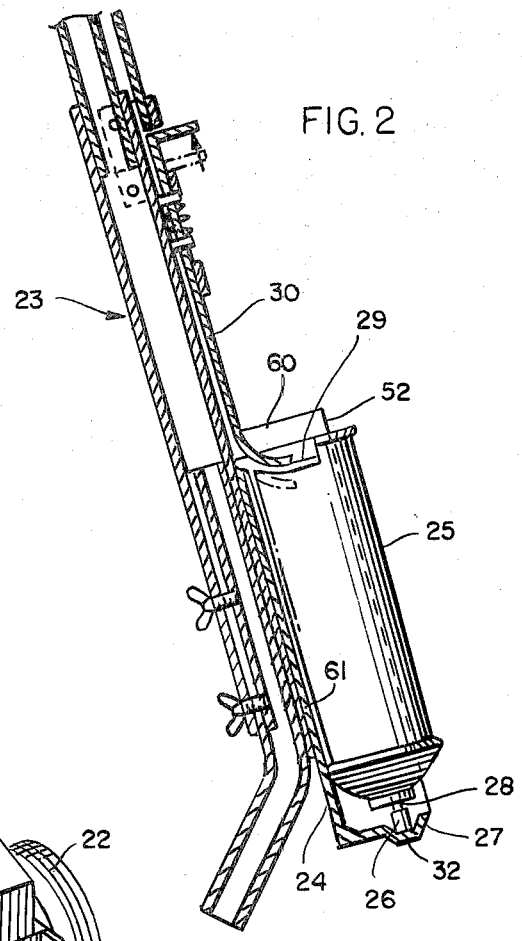
FIG. 2
23
30
29
60
52
25
61
28
27
32
24
26
40
41
47
37
36
FIG. 3
38
42
26
35
39
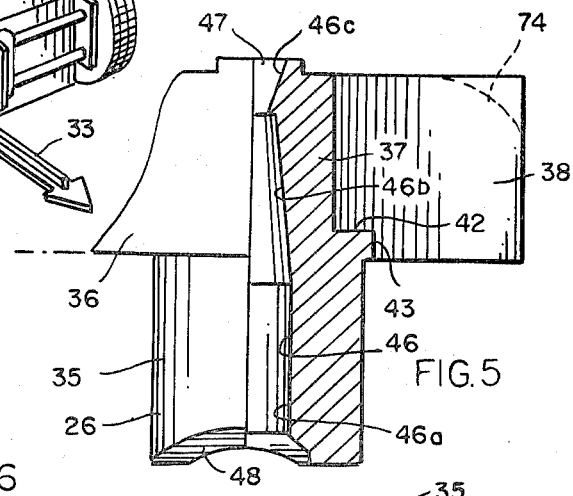
47
46c
74
37
38
46b
42
36
43
46
35
FIG. 5
26
46a
48
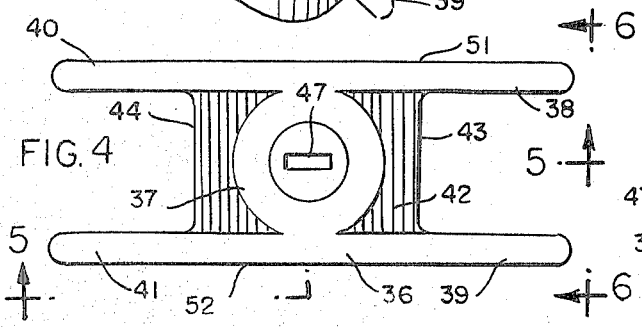
40
51
6
47
44
38
43
FIG. 4
5
37
42
5
41
52
36
39
6
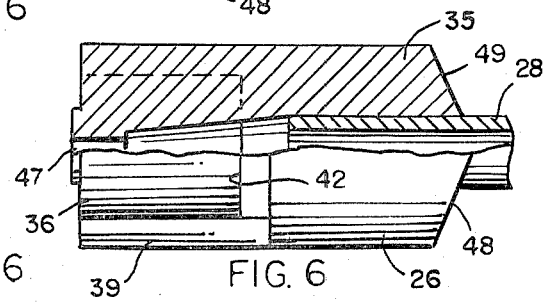
35
49
28
47
42
36
48
39
FIG. 6
26

SPRAY TIP FOR AEROSOL CAN

BACKGROUND AND SUMMARY

This invention relates a spray tip for an aerosol can.

My prior U.S. Pat. No. 3,817,429 describes a T-shaped spray tip or valve actuator for an aerosol spray can which has a rectangular spraying orifice and a pair of aligning surfaces which extend parallel to the rectangular spraying orifice. The aligning surfaces assist in orienting the spraying orifice when the spray tip is engaged by a sliding T-bar actuator.

My U.S. Pat. No. 4,262,821 illustrates a similar spray tip used with a can holder which has a bottom wall which is provided with a pair of inclined aligning surfaces for orienting the spray tip.

The invention provides a surprising improvement in the orientation of the spray tip. The spray tip includes flexible and resilient wings which extend parallel to the long dimension of the rectangular spraying orifice, and when the wings engage a sliding bar actuator or inclined surfaces, the wings flex and provide focus which tend to move the spray tip into the proper position. In the preferred embodiment a pair of wings extend from opposite sides of the spray tip to provide the spray tip with an H-shaped cross section. The two pairs of wings cooperate with aligning blocks between the inclined surfaces of the can holder.

DESCRIPTION OF THE DRAWINGS

The invention will be explained in conjunction with an illustrated embodiment shown in the accompanying drawings, in which FIG. 1 is a perspective view of a spraying apparatus and an aerosol spray can which is equipped with a spray tip formed in accordance with the invention;

FIG. 2 is a fragmentary sectional view through the handle of the spraying apparatus of FIG. 1;

FIG. 3 is an enlarged perspective view, partially broken away, of the spray tip;

FIG. 4 is a plan view of the spray tip;

FIG. 5 is a sectional view, partially broken away, taken along the line 5—5 of FIG. 4;

FIG. 6 is an end view, partially broken away, taken along the line 6—6 of FIG. 4 and showing the spray tip mounted on a valve stem of an aerosol can;

DESCRIPTION OF THE SPECIFIC EMBODIMENT

Figure 7:
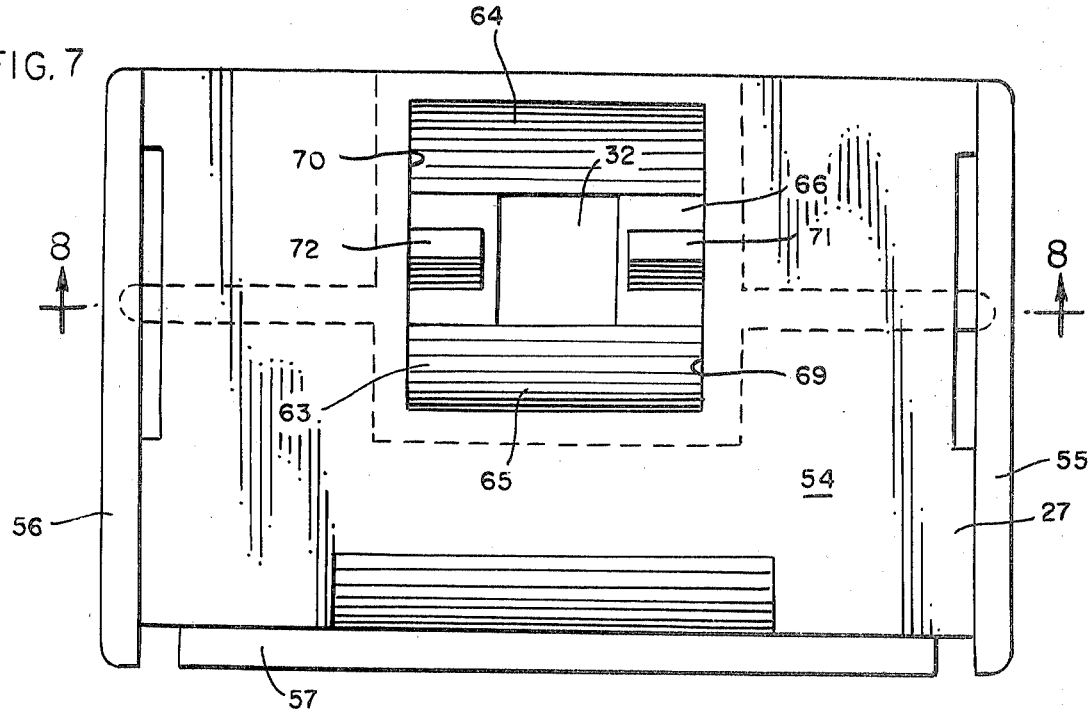
FIG. 7 is a top plan view of the stop plate of the aerosol can holder.

Referring first to FIG. 1, the numeral 20 designates generally a spraying apparatus of the type which is described in my co-pending U.S. patent application entitled "Spraying Apparatus", Ser. No. 278,164, filed June 29, 1981. The sprayer includes a housing 21 which rides on four wheels 22, and a handle assembly 23 which extends upwardly from the housing. The handle assembly is described in detail in U.S. Pat. No. 4,262,821.

The handle assembly includes a can holder 24 for holding an aerosol spray can 25 which is filled with paint, marking material, or the like. The aerosol can does not include a dip tube, and the contents of the can are sprayed when the can is upside down. The can is held in an inverted position by the can holder (see FIG. 2), and the spray tip or actuator 26 of the can is supported by a stop plate 27 which forms the bottom wall of the can holder. The valve of the aerosol can is of the type which is opened by moving the valve stem 28 (see also FIG. 6) either laterally toward the side of the can or axially toward the bottom of the can, i.e., the end 29 of the can opposite the valve stem.

The bottom 29 of the can is moved toward the stop plate to open the valve by an actuator rod 30 which is operated by a trigger 31 on the upper end of the handle assembly. When the valve is opened, the contents of the can are sprayed from the spray tip 26 through an opening 32 in the stop plate 27 and through the interior of the housing 21 onto the surface over which the sprayer is rolled. An arrow 33 on the front end of the sprayer is aligned with the stripe or mark made by spraying onto the surface and assists the operator in keeping the spraying apparatus in alignment along the desired path.

Referring now to FIGS. 3–6, the spray tip 26 includes a cylindrical base portion or mounting portion 35 and an aligning portion 36. The aligning portion 36 extends perpendicularly to the axis of the cylindrical mounting portion 35, and the spray tip is T-shaped in side elevation (FIGS. 3 and 5). The aligning portion 36 includes a cylindrical spraying portion 37 and four wing portions 38, 39, 40, and 41. The diameter of the cylindrical spraying portion 37 is less than the diameter of the mounting portion 35, and a radially extending shoulder 42 between the two cylindrical portions includes flat end edges 43 and 44 (FIG. 4) which extend between the wing portions.

A central bore 46 (FIGS. 5 and 6) extends through the spray tip and includes a cylindrical portion 46*a*, a first frusto-conical portion 46*b*, and a second frusto-conical portion 46*c* which terminates in a rectangular spraying orifice 47 (FIG. 4). The end of the mounting portion 35 is provided with beveled surfaces 48 and 49 as described in U.S. Pat. No. 3,817,429.

FIG. 6 shows the spray tip mounted on a conventional valve stem 28 of an aerosol can. The cylindrical portion 46*a* of the bore is sized to receive the valve stem rather snugly, and the valve stem is inserted to the frusto-conical portion 46*b*. Although the spray tip is inserted snugly on the valve stem, the spray tip is rotatable with respect to the valve stem.

Referring to FIG. 4, the wing portions 38 and 40 are aligned with each other and extend tangentially to the cylindrical spraying portion 37. The wing portions 39 and 41 are aligned with each other and also extend tangentially to the cylindrical spraying portion on the other side of the spraying orifice 47. The pair of wing portions 38 and 40 provide a flat aligning surface 51, and the pair of wing portions 39 and 41 provide a flat aligning surface 52. The aligning surfaces 51 and 52 extend parallel to each other and to the long dimension of the rectangular spraying orifice.

Still referring to FIG. 4, the pair of wing portions 38 and 39 extend laterally outwardly beyond the end 43 of the shoulder 42, and the pair of wing portions 40 and 41 extend laterally outwardly beyond the end 44 of the shoulder. The spray tip therefore has an H-shaped cross section in a plane which extends transversely through the cylindrical spraying portion 37. The end of each wing portion is advantageously rounded but could have other configurations.

The spray tip is preferably molded integrally from resilient and flexible plastic. The free ends of the wing portions which extend beyond the end edges 43 and 44 of the shoulder 42 are thereby made flexible and resilient. Although the specific embodiment of the spray tip which is illustrated in the drawings includes four wings, the spray tip can be provided with a different number of wings.

Figure 8:
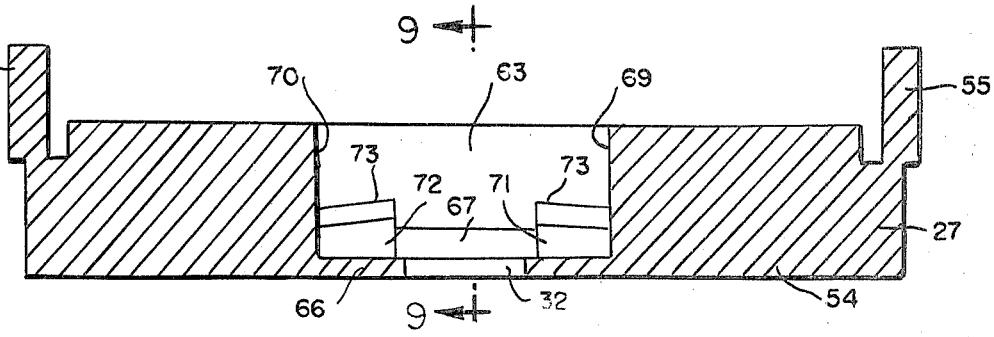
FIG. 8 is a sectional view of the can holder taken along the line 8—8 of FIG. 7.
Figure 9:
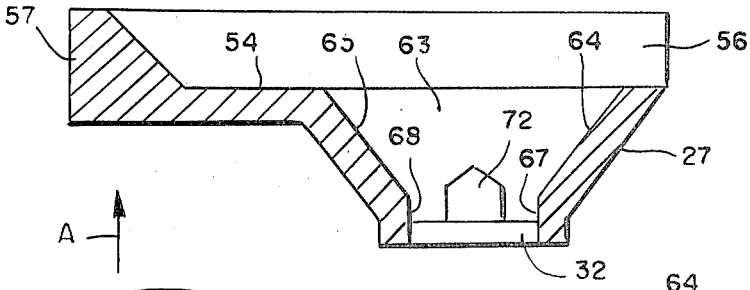
FIG. 9 is a sectional view taken along the line 9—9 of FIG. 7.

Referring now to FIGS. 7–9, the stop plate 27 of the can holder includes a flat bottom wall 54, a pair of side walls 55 and 56, and a rear wall 57. The can holder includes a metal channel 58 (FIGS. 1 and 2) which receives the aerosol can, and the sides 59 and 60 of the channel are adjacent to the side walls 55 and 56 of the stop plate, and the central wall 61 of the channel is connected or adjacent to the rear wall 57 of the stop plate.

The stop plate is provided with a recess 63 which is formed by front and rear inclined walls 64 and 65 and a bottom wall 66. The inclined walls terminate in relatively short downwardly extending walls 67 and 68 (FIG. 9). The side surfaces 69 and 70 of the recess extend perpendicularly to the bottom wall 66 and the downwardly extending walls 67 and 68.

The opening 32 extends through the bottom wall 66, and a pair of aligning blocks 71 and 72 extend upwardly from the bottom wall. The aligning blocks are advantageously spaced equidistant from the downwardly extending walls 67 and 68. Each aligning block has an inverted V-shaped upper surface, and the ridge 73 (FIG. 8) of each aligning block is advantageously inclined downwardly from the inner end of the aligning block to the flat side wall 69 or 70 of the recess.

When the aerosol can is positioned in the can holder, the rectangular spraying orifice should be positioned so that its long dimension extends perpendicularly to the direction in which the sprayer is rolled over the surface. The inclined walls 64 and 65 and the aligning blocks 71 and 72 of the stop plate help ensure that the spraying orifice will be properly aligned when the aerosol can is inserted properly.

Figure 10:
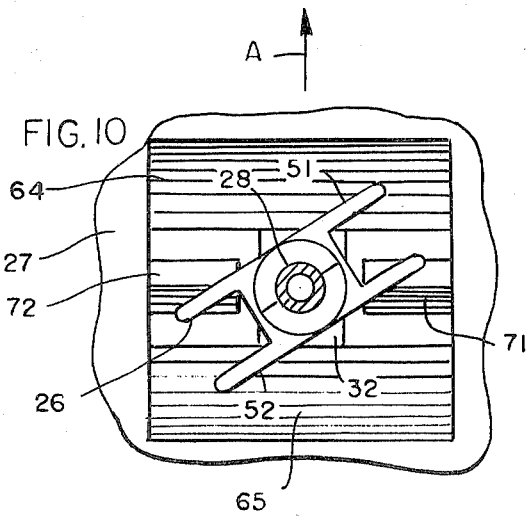
FIG. 10 is a fragmentary sectional view taken through the valve stem of FIG. 2 showing the spray tip about to engage the inclined aligning surfaces of the stop plate.
Figure 11:
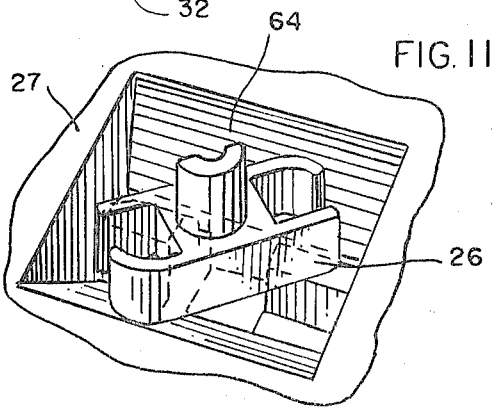
FIG. 11 is a fragmentary perspective view showing the spray tip being oriented by the inclined aligning surfaces of the stop plate.

FIG. 10 illustrates the spray tip 26 as the aerosol can is being inserted into the can holder. The aligning surfaces 51 and 52 and therefore the rectangular spraying orifice 47 are not aligned perpendicularly to the direction in which the sprayer moves, which is indicated by the arrow A. As the aerosol can is inserted into the can holder, one of the wing portions 38–41 (FIG. 4) will engage each of the inclined aligning surfaces 64 and 65. As the can continues to be moved downwardly toward the stop plate, the wings which engage the inclined surfaces will be flexed (see FIG. 12), and the flexed, resilient wings will provide a force which will tend to rotate the spray tip on the valve stem 28 until the aligning surfaces and the rectangular spraying orifice are oriented so that the long dimension of the rectangular orifice is perpendicular to the arrow A. The inclined ridges 73 of the aligning blocks assist in orienting the spray tip since the wing portions which engage the ridges will tend to slide down the ridges and rotate the spray tip. If desired, the corners of the wing portions can be rounded as indicated in phantom at 74 in FIG. 5 in order to facilitate the insertion and alignment of the spray tip.

Figure 13:
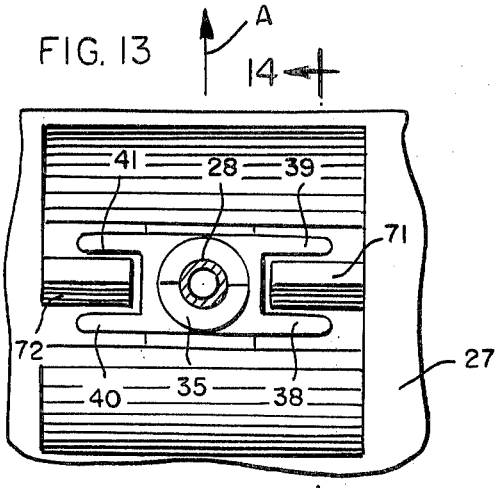
FIG. 13 is a top plan view similar to FIG. 12 showing the spray tip properly positioned within the stop plate.
Figure 14:
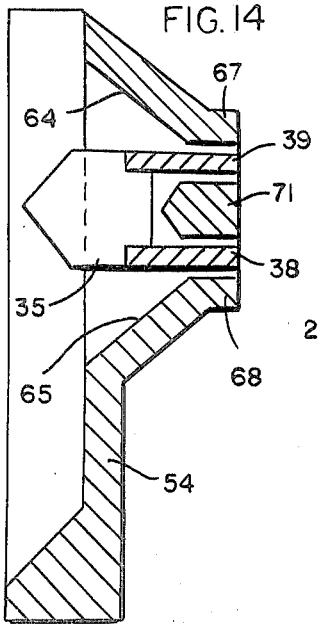
FIG. 14 is a sectional view taken along the line 14—14 of FIG. 13.

FIGS. 13 and 14 show the spray tip after it has been properly oriented. In this position the aligning blocks 71 and 72 fit between adjacent pairs 38 and 39; and 40 and 41; respectively, of the wings. Each wing is positioned between one of the aligning blocks and one of the short downwardly extending walls 67 or 68, and the spray tip is substantially secured against movement in any direction—side-to-side, front-to-back, rotational, or downward. The spraying orifice is thereby rather precisely positioned within the sprayer, and when the aerosol can is depressed by the actuator rod 30 (FIGS. 1 and 2) to open the can valve, the spray will be directed properly.

Figure 12:
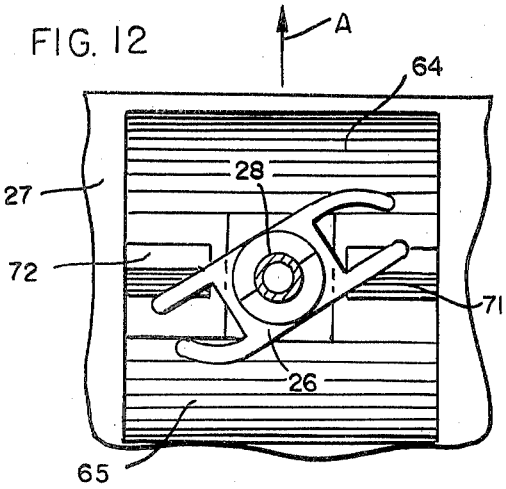
FIG. 12 is a top plan view of FIG. 11.

The short downwardly extending walls 67 and 68 between which the aligning surfaces of the wings are positioned to extend perpendicularly to the direction in which the sprayer is advanced (indicated by the arrow A in FIGS. 12 and 13). Similarly, each of the inclined aligning surfaces 64 and 65 extend in a plane which is parallel to a line which extends perpendicularly across the line in which the sprayer advances.

I have found that the spray tip will be aligned by the cooperation between the wings and the inclined aligning surfaces 64 and 65 and by the cooperation between the wings and the aligning blocks even if the wings do not flex. However, optimum results are obtained when the wings flex. It is believed that flexing of the wings sometimes actually results in a snapping of the spray tip into the proper position when sufficient energy is stored in the flexed wings to overcome forces which resist the orienting of the spray tip.

Figure 15:
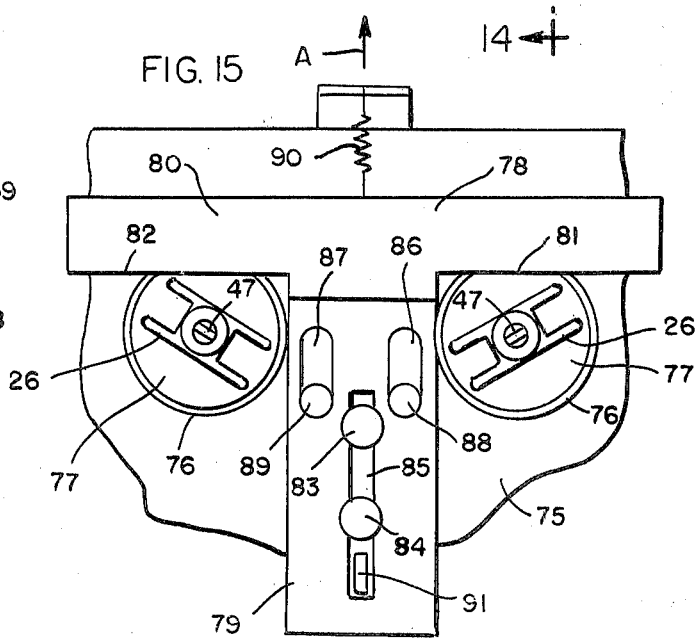
FIG. 15 is a fragmentary bottom plan view of a pair of aerosol cans with spraying tips mounted in a spraying apparatus which is equipped with a sliding T-bar actuator.
Figure 16:
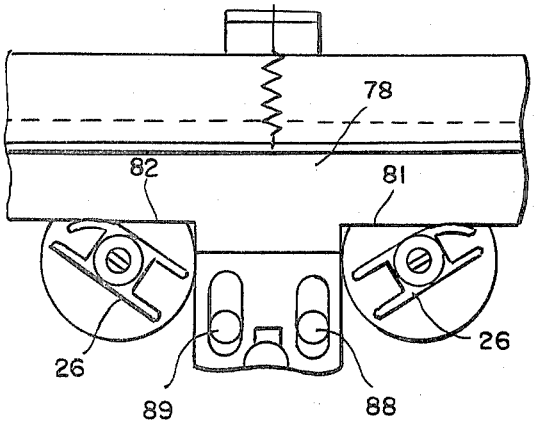
FIG. 16 is a view similar to FIG. 15 showing the sliding T-bar actuator engaging the spray tips.
Figure 17:
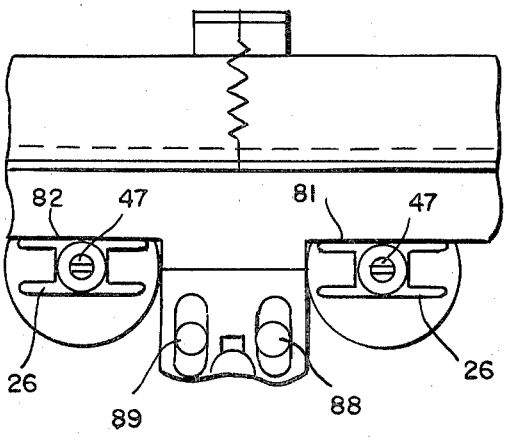
FIG. 17 is a view similar to FIGS. 15 and 16 showing the spray tips properly aligned.

The spray tips can also be used in a spraying apparatus of the type described in my prior U.S. Pat. Nos. 3,700,144, 3,796,353, and 3,817,429. This type of sprayer is described in detail in the prior patents, and a portion of the apparatus is illustrated in FIGS. 15–17. The sprayer includes a base plate 75 which is provided with a pair of openings 76 for receiving the dome-like tops 77 of a pair of aerosol cans. The openings 76 have a diameter slightly less than the maximum diameter of the dome portions so that these portions of the can can be held rather securely in the openings.

The valves of the aerosol cans are of the type which are opened by lateral movement, i.e., movement in a direction perpendicular to the axis of the can. The valves are operated by a generally T-shaped actuating bar 78 which is slidably mounted to the lower surface of the base plate 75. The actuating bar includes an elongated sliding or attaching portion 79 and a transversely extending valve-actuating portion 80 having a pair of generally flat actuating edges 81 and 82. The slide portion 79 is slidably secured to the base plate between the openings 76 by bolts 83 and 84 which extend through a longitudinally extending slot 85 in the slide portion. The enlarged head portions of the bolts hold the slide portion adjacent the base plate, and the shank portions of the bolt cooperate with the slot 85 to guide the sliding movement of the actuating bar along a line equidistant from the centers of the openings 76. The actuating bar is also guided by a pair of pins 86 and 87 which extend downwardly from the base plate and which cooperate with elongated slots 88 and 89 in the slide portion.

The forward portion 80 of the actuating bar 78 is offset away from the base plate 75 to position the actuating portion 80 adjacent to spray tips 26 which are mounted on the valve stems of the aerosol cans. The actuating bar is biased to a non-actuating position shown in FIG. 15 in which the actuating bar does not engage the spray tips by a spring 90 which is secured to the frame of the spraying apparatus.

Sliding movement is imparted to the actuating bar by a bell crank 91 which extends downwardly through the base plate and through the rearward portion of the slot 85 in the actuating bar. When the actuating bar is moved toward the spray tips by the bell crank, the flat actuating edges 81 and 82 of the actuating bar will engage one of the wings of each of the spray tips if the aligning surfaces of the spray tips are not parallel with the actuating edges 81 and 82. As the actuating edges 81 and 82 engage the wings, the wings will flex as illustrated in FIG. 16 and will impart a rotational force on the spray tip which will rotate the spray tip on the valve stem until the aligning surface of the spray tip is parallel to the actuating edge of the actuating bar as shown in FIG. 17. In this position the long dimension of the rectangular spraying orifice 47 of each of the spray tips extends perpendicularly to the direction in which the spraying apparatus is rolled over the surface.

While in the foregoing specification a detailed description of a specific embodiment of the invention has been set forth for the purpose of illustration, it will be understood that many of the details hereingiven may be varied considerably by those skilled in the art without departing from the spirit and scope of the invention.

I claim:

1. In a spraying apparatus having an aerosol can holder, and an aerosol can mounted in the can holder, the can holder having a bottom wall for supporting the aerosol can, the improvement comprising a spray tip mounted on the aerosol can, the spray tip having a spraying portion having a rectangular spraying orifice and wing portions extending from the spraying portion generally parallel to the long dimension of the spraying orifice, the bottom wall of the can holder having an opening through which the contents of the aerosol can can be sprayed, a pair of inclined surfaces diverging outwardly and upwardly from the opening, each of the inclined surfaces extending in a plane which is generally parallel to a line which extends perpendicularly to the direction in which the spraying apparatus is rolled, and a pair of aligning blocks on the bottom wall between the inclined surfaces, the aligning blocks being sized and arranged to position the wing portions and the long dimension of the spraying orifice generally perpendicular to the direction in which the spraying apparatus is moved.

2. The structure of claim 1 in which the spray tip includes a pair of wing portions extending from the spraying portion on opposite sides of the spraying orifice, the aligning blocks being positioned between the pairs of wing portions when the long dimension of the spraying orifice is perpendicular to the direction in which the spraying apparatus is moved.

3. The structure of claim 1 in which each of the aligning blocks has an upper surface which slants downwardly as it extends away from the opening in the bottom wall.

4. The structure of claim 1 in which each of the aligning blocks has an inverted V-shaped upper surface and an upper edge which slants downwardly as it extends away from the opening in the bottom wall.

5. The structure of claim 4 in which the wing portions are flexible and resilient.

6. The structure of claim 2 in which the wing portions are flexible and resilient.

7. The structure of claim 2 in which the spray tip is molded from flexible and resilient material whereby the wing portions are flexible and resilient.

8. A spray tip for an aerosol can comprising a spraying portion having a spraying orifice and two pairs of spaced-apart wing portions, each pair extending from the spraying portion on opposite sides of the spraying orifice whereby the spray tip has a generally H-shaped configuration in a plane perpendicular to the spraying orifice.

9. The spray tip of claim 8 in which the spraying orifice is generally rectangular and has a long dimension which extends generally parallel to the wing portions.

10. The spray tip of claim 8 in which the spray tip is molded from flexible and resilient material whereby the wing portions are flexible and resilient.

* * * * *